United States Patent [19]

Shiokawa

[11] 4,016,742

[45] Apr. 12, 1977

[54] PRESS-FORMING APPARATUS

[76] Inventor: Seiji Shiokawa, 110-6 Matsumoto, Mishima, Shizuoka, Japan

[22] Filed: Sept. 15, 1975

[21] Appl. No.: 613,310

[52] U.S. Cl. ..... 72/465; 72/389

[51] Int. Cl.[2] ..... B21D 5/02

[58] Field of Search ..... 72/389, 465; 267/119

[56] References Cited

UNITED STATES PATENTS

| | | | |
|---|---|---|---|
| 3,702,558 | 11/1972 | Swenson | 72/389 |
| 3,829,074 | 8/1974 | Hanni et al. | 267/119 |
| 3,914,975 | 10/1975 | Kawano | 72/389 |

*Primary Examiner*—Lowell A. Larson
*Attorney, Agent, or Firm*—Kurt Kelman

[57] ABSTRACT

In a press for forming a long and narrow plate or strip of metal or synthetic resin into an elongated beam having an L-shaped section, of the type having a lower fixed frame provided with a female die on the top thereof and a hydraulically operated upper movable frame provided with a male die on the bottom thereof, a long space adjacent and parallel to the lower surface of the movable frame is provided in the movable frame. In the space are provided a plurality of small hydraulic deflection cylinders with pressure-fluid paths connected to the pressure-fluid paths of the main hydraulic cylinders to drive the movable frame. The space provided with a plurality of the small hydraulic deflection cylinders is so located that the center portion of the lower part of the movable frame is deflected counter to the deflection of the movable frame under press-forming load. When hydraulic pressure fluid is supplied to the main hydraulic cylinders to drive the movable frame for forming the plate by means of the dies fitted on the frames, the pressure fluid is also supplied to the plurality of the small hydraulic deflection cylinders in the space of the movable frame and the primary deflection of the frames under load is compensated for, so that a beam of L-shaped section free from convex or concave warp at its center portion is produced.

3 Claims, 15 Drawing Figures

PRESS-FORMING APPARATUS

BACKGROUND OF THE INVENTION

The present invention relates to a press for forming a long and narrow metal or synthetic resin plate, sheet or strip into a beam of L-shaped section free from convex or concave warp.

In particular, the present invention relates to a press-forming apparatus comprising a laterally long fixed frame, a movable frame of a length substantially equal to that of the fixed frame, a space provided adjacent and parallel to a die mounting surface of the movable frame, a plurality of small hydraulic cylinders (hereinafter, referred to as the "deflection cylinders") provided in the space independently from the main hydraulic cylinders of the movable frame for compensating for deflection of the fixed frame and the movable frame during pressing and pressure-fluid paths for the small hydraulic deflection cylinders connected to the pressure-fluid paths of the main hydraulic cylinders.

In general, press-forming apparatuses for press-forming a long and narrow metal or synthetic resin strip sheet or plate (referred to as the "material" hereinafter) into a beam L-shaped in section utilize a pair of parallel disposed C-shaped support frames as a base structure support for the fixed and the movable frames, a fixed frame and a movable frame which is vertically movable by a crank mechanism and other mechanical mechanisms or hydraulic or air cylinders.

In the conventional apparatus for this purpose, there is a very important disadvantage irrespective of the driving mechanisms or the guiding mechanisms used to operate the movable frame. This disadvantage is related to the deflection of the fixed frame and the movable frame caused by the pressing force exerted thereon and the resilient force of the material to be pressed and appears as an undesired deformation of the pressed material. The undesired deformation appears as either a concave or a convex warp of the center portion of the pressed material.

In order to eliminate such undesired deformation it is usual to make the rigidities of the fixed frame and the movable frame sufficient to withstand the deflection force, to preliminarily machine a crown into the movable frame so that when the frame is deflected the surface thereof becomes flat or to shim the dies mounted on the frame. These methods are, however, not satisfactory and a more effective method for compensating for the deflection of the frames is required.

An object of the present invention is to provide a press-forming apparatus for press-forming a long material into a beam of L-shaped section without concave or convex warp of the center portion thereof.

SUMMARY OF THE INVENTION

In order to achieve the above mentioned object, the present apparatus comprises a laterally long fixed frame, a movable frame having a die mounting surface at a position corresponding to the die mounting surface of the fixed frame, main hydraulic cylinders for actuating the movable frame, a space provided adjacent and parallel to the die mounting surface of the movable frame and a plurality of small hydraulic deflection cylinders provided in the space and having fluid paths connected to the fluid paths of the main hydraulic cylinders.

In a press-forming apparatus having such construction, when a material to be formed is put on the die mounting surface of the fixed frame and hydraulic fluid is supplied to the main hydraulic cylinders to drive the movable frame downwardly to thereby press the material, the same fluid is also supplied to the deflection cylinders in the space, so that the width of the space is enlarged to compensate for the deflection of the movable frame and the fixed frame. Further, with the enlargement of the space width, the resilient force of the pressed material becomes uniform along the bend line and is reduced, resulting in nearly complete elimination of the convex or concave warp of the center portion of the pressed material.

The above and other objects and features of the present invention will be described in more detail with respect to the attached drawings in which.

Figure 1:
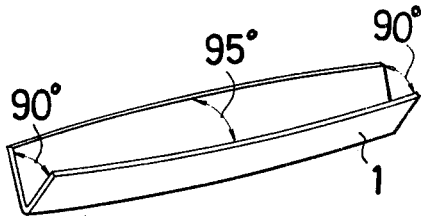
FIG. 1 is an explanatory illustration of the convex warp phenomenon of the center portion of the shaped metal plate.
Figure 2:
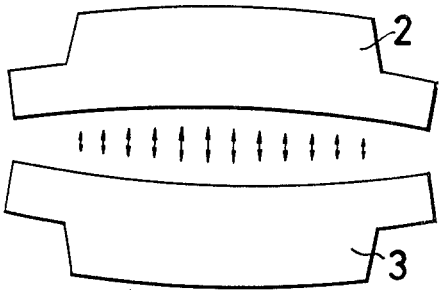
FIG. 2 is an explanatory illustration showing how such convex warp phenomenon occurs.

Returning to FIG. 1, the convex warp phenomenon which occurs in the center portion of a press-forming beam of L-shaped section (hereinafter called the "beam") is schematically illustrated. The convex warp is a phenomenon wherein the inside angle at the center of the beam becomes larger than the angles at the ends, when the pressing force is removed. This phenomenon is due to the non-uniform resilient returning force of the material along the length thereof and therefore, if the resilient returning force can be so controlled that it is generated uniformly along the full length of the deflected beam, convex warp can be eliminated. However, since the pressing force exerted on the press-formed beam 1 by the movable frame 2 and the fixed frame 3 is different at the end portions and the center portion thereof due to deflection, as shown in FIG. 2, the center portion of the beam where deflection of the frames 2 and 3 is larger than at other portions will be pressed with relatively weaker force even if the pressing force is apparently applied uniformly to the beam. Furthermore, since the pressing stress is applied to the end portions of the material without interference by the deflection, the resilient returning force in the product is weaker in the end portions and stronger in the center portion, resulting in center convex warp.

Figure 4:
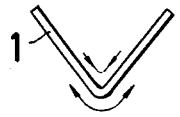
FIGS. 4 and 5 are explanatory illustrations showing how such center concave warp occurs.
Figure 5:
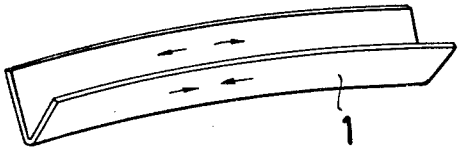
Figure 3:
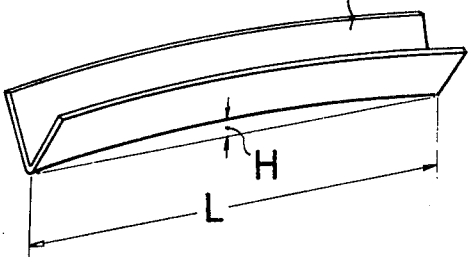
FIG. 3 is an explanatory illustration of the concave warp phenomenon of the center portion of the shaped metal plate.

The concave warp is a phenomenon wherein the material chambers, as shown in FIG. 3, when it is deflected into a beam with "L" shape in section. This phenomenon occurs because, as shown in FIG. 4, a compressive residual stress acts on the inner surface of the beam and a tensile residual stress acts on the outer surface thereof, so that the transversal distribution of the compressive risidual stress and the tensile residual stress is, as shown in FIG. 5, such that tensile stress and compressive stress are generated lengthwise on the inner surface and on the outer surface of the deflected beam respectively. The magnitude of the warp depends upon the nature of the material forming the beam 1, the thickness of the material and the radius of curvature of the corner etc. and, in general, the ratio H/L is on the order of 0.001 to 0.005 where H is the maximum height of the chamber which is represented, as shown in FIG. 3, by the clearance between the line connecting the outer corners of the two ends of the deflected beam and the outer corner at any point bowed most and L is the length of the beam.

In order to avoid the occurrence of the above mentioned possible deflection of the beam 1, that is, the concave warp or convex warp of the center portion of the beam 1, various methods have been employed.

Figure 6:
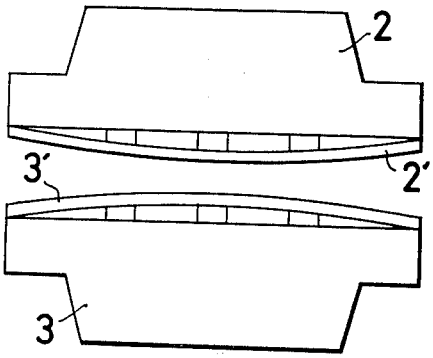
PRIOR ART Fig. 6
FIG. 6 is an explanatory illustration of one of the conventional methods of compensating for the deflection of the respective frames.

In one of the conventional methods, crowned steel blocks 2′ and 3′ are provided one between the fixed frame and its die, and one between the movable frame and the die, as shown in FIG. 6, so that the resilient returning force of the press formed beam 1 becomes uniform throughout the length thereof. In this method, however, the fabrication of th e shims themselves requires a long time and skilled labor. In addition to this, since the amount of the deflection of the frames 2 and 3 varies with the nature of the material and the applied load or tonnage, a different crowned steel block must be prepared for each new job.

Figure 7:
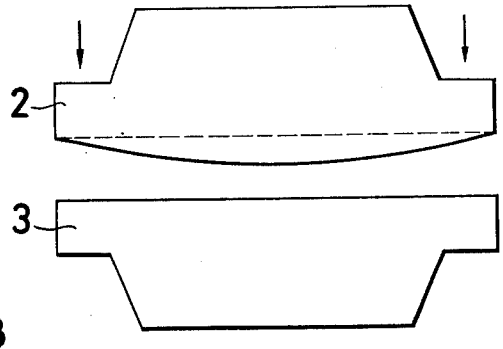
PRIOR ART Fig. 7
FIG. 7 is an explanatory illustration of another method of compensating for the deflection.

In a second conventional method, the deflections which would occur on the faces of the movable frame 2 and the fixed frame 3 on which the dies are mounted are preliminarily calculated and corrections corresponding to the calculated deflections are preliminarily applied to the movable frame 2 or the fixed frame 3 or to both of them, as shown in FIG. 7. According to this second method, the problems of time consumption and the skillfulness required to prepare the shims are overcome. However, the amount of correction is constant even though the deflection of the respective frames varies in proportion to the pressing force. Therefore, the deflection cannot be corrected for the whole range of the pressing forces.

Figure 8:
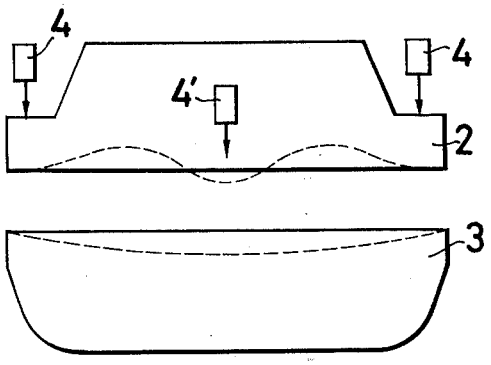
PRIOR ART Fig. 8
FIG. 8 is an explanatory illustration of a further method of doing the same.

In a third conventional method, a pair of pressing cylinders 4, 4 for press forming are provided at opposite ends of the movable frame 2, as shown in FIG. 8, and an additional cylinder 4′ is provided at the center of the movable frame 2 or the fixed frame 3. The latter cylinder serves as a pressure cylinder as well as a correction cylinder for the deflection. According to the third method, the deflection of the center portion of the beam 1 can be corrected. However, since deflections occur between one of the main cylinders 4 and the additional cylinder 4′ as shown by the broken line in FIG. 8, this method does not prevent the deflection.

Figure 9:
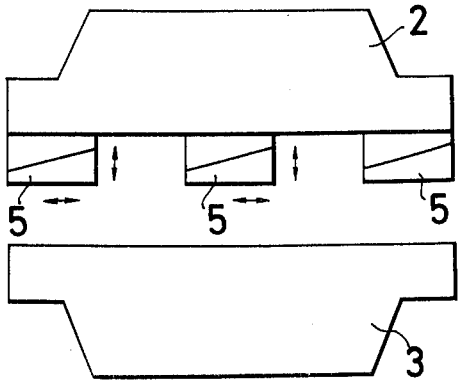
PRIOR ART Fig. 9
FIG. 9 is an explanatory illustration of a still further method of doing the same.

In a fourth conventional method, as shown in FIG. 9, a plurality of wedge type blocks 5 are provided between the die and the die mounting surface of both of the frames. By adjusting the wedges of the blocks, the die can be deflected preliminarily at any desired portion and in desired amount to compensate for the deflection of the frame under load. Even with the fourth method, the adjustment of the wedge type blocks requires much time and skilled labor. In addition to this, the structure of the press machine becomes complicated and expensive.

According to the present invention, the above mentioned disadvantages of the conventional press-shaping apparatus are completely removed. That is, according to the present invention, the deflections of the movable frame and the fixed frame are positively and steplessly corrected for every material to be shaped and for any magnitude of pressing force without necessity of adjustment or skillfulness as required by conventional apparatus to prevent the pressing force from becoming nonuniform throughout the material so that the convex or concave warp of the center portion of the pressed beam is substantially eliminated.

Figure 10:
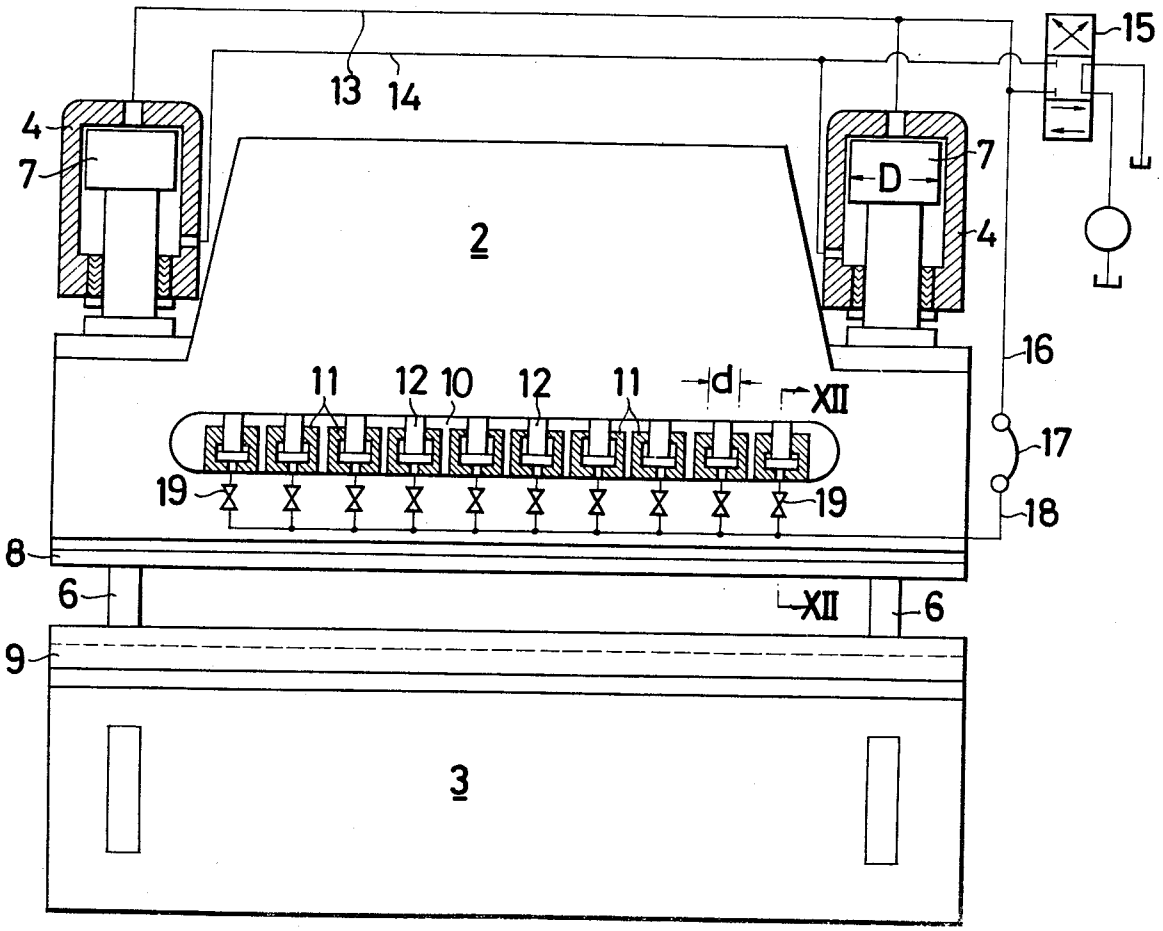
FIG. 10 is a front view of an embodiment of the press-forming apparatus according to the present invention.
Figure 11:
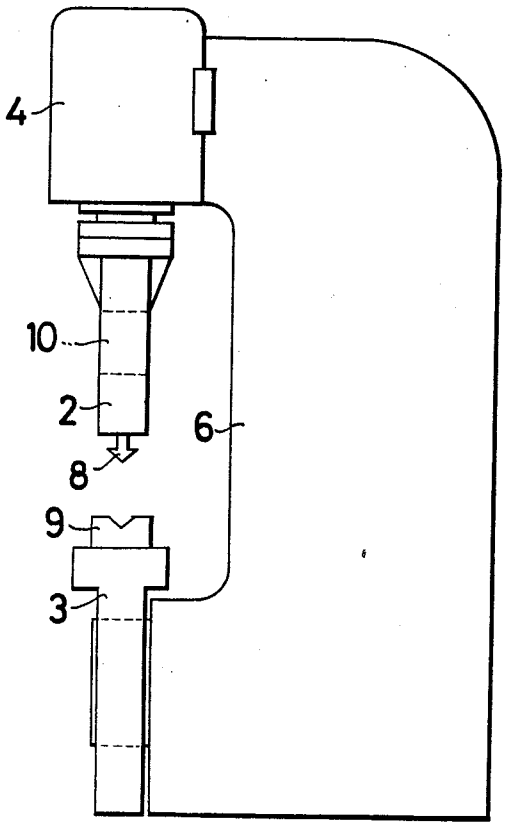
FIG. 11 is a side view of the press-forming apparatus in FIG. 10.

Referring to FIGS. 10 and 11, a pair of right and left C-shaped side frames 6 and 6 installed in parallel with each other provide the basic structural supports for the lower fixed frame 3 and the upper movable frame 2. On each of the upper front surfaces of the side frames 6, 6 is fixed a main hydraulic cylinder 4 for moving the movable frame 2, and on their lower front surfaces is fixed frame 3 having a female die 9 on its top. The movable frame 2 having male die 8 on its bottom is so connected to the lower ends of the piston rods affixed to pistons 7, 7 of the main hydraulic cylinders 4, 4 that it is aligned with the fixed frame 3 and can be moved vertically by actuation of the main hydraulic cylinders 4, 4. The upper die 8 and the lower die 9, the heights of which are preliminarily determined to allow the two dies to meet each other when the movable frame 2 comes down to the fixed frames 3, are mounted facing each other and in alignment with each other on the bottom of the movable frame 2 and the top surface of the fixed frames 3 respectively. The material on th lower die 9 is pressed and formed between the dies by moving the movable frame 2 downward as the pressing force of main hydraulic cylinders 4, 4 is exerted onto the material through the movable frame 2 and its die 8.

A long hole shaped space 10 is provided in the movable frame 2 adjacent to and along the lower end thereof, and in the space 10, there are provided in a row a plurality of small hydraulic deflection cylinders to compensate for deflection.

Figure 12:
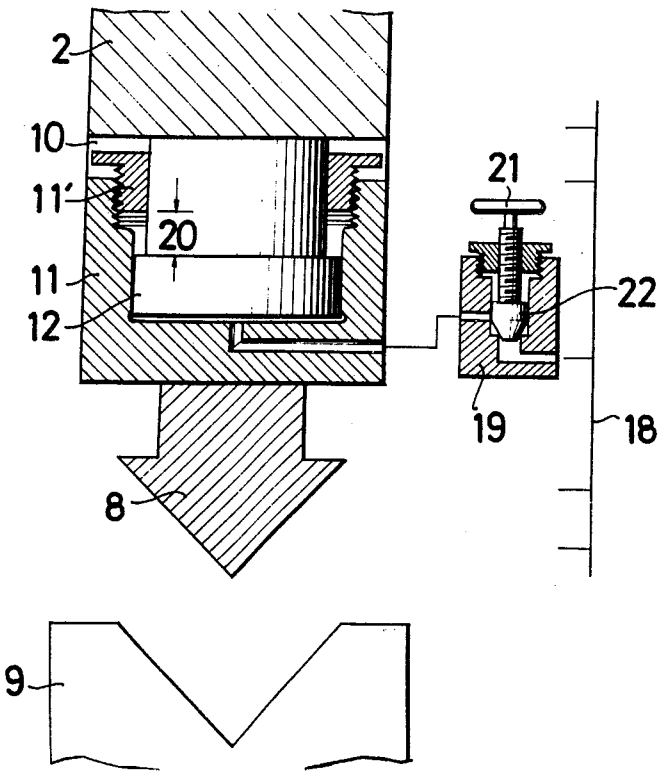
FIG. 12 is an enlarged sectional view of the apparatus in FIG. 10 taken along line XII — XII in the same Figure.

The top end of the ram 12 of each of the deflection cylinders 11 is adjusted such that it is in contact with the upper wall face of the space 10 when the ram enters the deflection cylinder 11, as shown in FIG. 12. The total cross sectional area of the rams of the deflection cylinders 11 is substantially the same as the total cross sectional area of the pistons 7 of the two main hydraulic cylinders 4. That is, where the diameter of the piston 7 is D, the diameter of rams 12 is $d$ and the number of the deflection cylinders 11 is $n$, the following equation is established:

$$\pi/4D^2 \times 2 \div \pi/4d^2 \times n$$

Therefore, the number $n$ of the deflection cylinders 11 becomes as follows:

$$n \div 2D^2/d^2$$

Fluid pipe 13 through which hydraulic pressure fluid for actuating the movable frame 2 in downward direction is supplied into the hydraulic cylinders 4 are connected to the upper ends of the hydraulic cylinders 4 and fluid pipe 14 through which fluid for actuating the movable frame 2 in upward direction is supplied into the cylinders of are connected to lower ends of the hydraulic cylinders 4.

The pipes 13 and 14 are further connected to a directional control valve 15 which switches the fluid path between the pipes 13 and 14 to supply hydraulic pressure fluid to the cylinders 4 to lower the movable frame 2 for press-forming and then to lift it back to the initial position.

A branch pipe 16 is connected between the pipe 13 and pipe 18 for the deflection cylinders through flexible pipe 17. The other end of the pipe 18 is connected to deflection cylinders 11 through stop valves 19. The stop valve 19 need not necessarily be provided and the pipe 18 can be directly connected to the deflection cylinders 11.

Therefore, when a pressure fluid is supplied to the pipe 13 for downward movement of the movable frame 2, it is also supplied to the branch pipe 16 and then, through the flexible pipe 17 and the pipe 18 to the respective deflection cylinders 11. By this supply of pressure fluid to the cylinders 4, the movable frame 2 is lowered and thus the male die 8 mates with the female die 9 on the fixed frame 3, so that the material disposed therebetween is press-formed.

Since the pressure fluid is supplied from the branch pipe 16 to the deflection cylinders 11, the pressing force due to the respective deflection cylinders 11 becomes substantially the same as that provided by the cylinders 4, and since the pressing force due to the cylinders 11 is distributed uniformly in the space 10, the deflection of the dies which would occur due to the deflection of the movable frame and the fixed frame by the actuation of the hydraulic cylinders 4 is corrected by the fluid pressures provided by the deflection cylinders 11 and the dies can mate uniformly and intimately. It should be noted that the force provided by the deflection cylinders provides substantially no direct force to press the material between the dies mounted on the movable frame and the fixed frame. That is, the pressing force of the male die 8 on the movable frame is produced only by the hydraulic cylinders 4 and the force produced by the deflection cylinders 11 is utilized to downwardly deflect the male die when the movable frame, the fixed frame and the dies thereon are deflected upwardly by the pressure cylinders 4 to thereby cancel out the opposite deflection.

Therefore, when a material having a length equal to the length of the dies is pressed, the stop valves 19 may be opened or removed completely and the pipes 18 connected directly to the deflection cylinders 11 so that a pressure in proportion to the pressure provided by the hydraulic cylinders 4 is exerted on the deflection cylinders 11 to thereby cancel out the deflection of the male die 8.

On the other hand, where the length of the material to be pressed is shorter than that of the dies or a precise pressed angle is required, it is recommendable to supply pressure fluid to the pipe 13 and the branch pipe 16 to deflect the male die 8 downwardly beforehand with a previously calculated pressure exerted on the movable frame 2 and to maintain the deflection of the male die by closing the stop valves 19. Since, by this operation, the male die 8 is deflected beforehand by an amount corresponding to the deflection in working even when the movable frame 2 is lifted by the fluid supply to the pipes 14 by switching the directional control valve 15, there is no harmful warping of material when it is disposed between the dies thereafter and pressed thereby. The deflection degree of the male die 8 can be arbitrarily regulated by opening and closing the stop valves 19 and therefore any material can be precisely pressed to L-shape without distortion. In addition, since the deflection of the male die 8 is determined by the pressure of the fluid supplied to the respective deflection cylinders and can easily be maintained by merely closing the stop valves 19, no skillfulness and/or long setup time is required.

FIG. 12 shows an enlarged cross sectional view of the present apparatus taken along line XII—XII in FIG. 10. The diameter of the deflection cylinder 11 is preferrably selected as substantially equal to or somewhat larger than the thickness of the movable frame 2 and, by mounting stoppers 11' of the rams 12 on the cylinders 11, the stroke 20 of the ram 12 is regulated between an upper jaw of the ram 12 and a lower jaw of the stopper 11' during the downward movement of the ram 12.

The stroke 20 should be determined by previously calculating the deflection of the frames 2 and 3 under the maximum loads on the frames 2 and 3. With the stroke 20 equal to the calculated value, it is possible to avoid deformation due to abnormal pressures exerted on the male die mounted on the movable frame 2 which may result from irregular actuation of the deflection cylinders 11 due to malfunction of the apparatus or from pressing of shorter material than intended.

Each of the stop valves 19 is provided with a control valve poppet 22 vertically shiftable by a handle 21 so that the fluid path to the cylinder 11 can be closed by seating the poppet 22 by the handle 21. On the other hand, the path to the cylinder 11 is connected to the pipe 18 by lifting the poppet 22 by the handle 21.

Although the stop valves 19 are shown as manual valves in the above embodiment, it is possible to use as the stop valves electro-magnetic valves or mechanical valves which can simultaneously be operated.

It will be clear that the stroke of the rams 12 may be much shorter than that of the pressure rams 7 because the deflection rams 12 serve only to deflect the face of the movable frame 2 on which the male die is mounted.

The strokes of the rams 12 vary depending upon the length of the face of the movable frame, the magnitude of the pressing force and/or the moment of inertia of sections of the respective frames 2 and 3. However, strokes of 2mm at most should be sufficient for most applications with the exception of a few very special instances. Therefore, since the diameter of the deflection cylinders 11 may be substantially equal to the thickness of the movable frame 2 and it is sufficient to move the ram 12 thereof vertically by about 1mm, the stroke of the ram 12 may be made several tens of times smaller than that of the hydraulic cylinder 4. The number of the deflection cylinders 11 to be provided in the movable frame 2 is determined mainly by the diameter of the hydraulic cylinders 4 and that of the deflection cylinders 11 themselves. It will be understood that the larger the number of cylinders 11 the better because the deflecting distribution along the movable frame 2 becomes more uniform. However, since increasing the number of the deflection cylinders makes the construction of the apparatus complex and expensive, there is a limitation on the number of the deflection cylinders in view of economy. It has been found that about fifteen deflection cylinders for a three-meter movable frame and about twenty for a five-meter movable frame are sufficient to provide uniform deflection of the movable frames which are satisfactory practically.

In the embodiment described hereinbefore, a space 10 is provided in the movable frame 2 and a plurality of deflection cylinders 11 are provided in the space 10. As an alternative, the deflection cylinders may be provided not in the space 10 but between the lower end face of the movable frame and a deflection plate which is to be deflected.

Figure 13A:
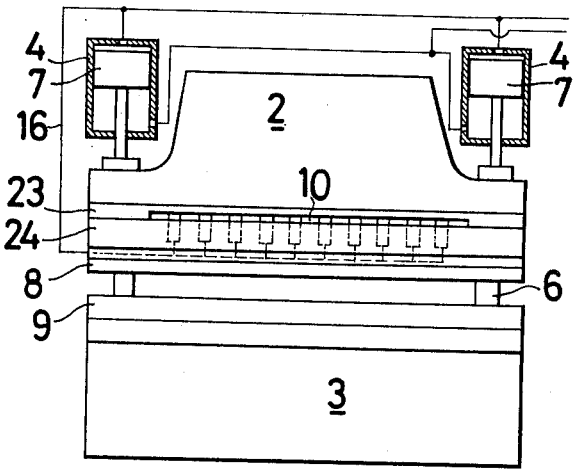
FIG. 13(A) is a front view of another embodiment of the press-forming apparatus according to the present invention.
Figure 13B:
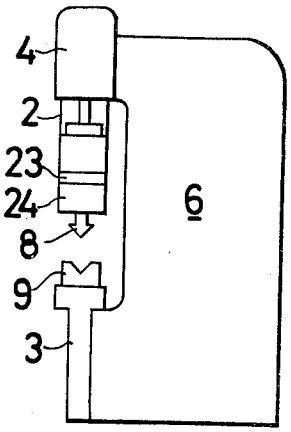
FIG. 13(B) is a side view of the embodiment in FIG. 13(A)
Figure 14:
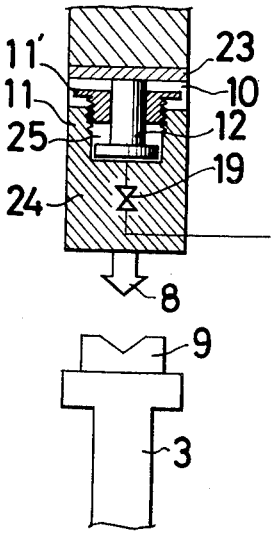
FIG. 14 is an enlarged sectional view of the embodiment in FIG. 13.

Referring to FIGS. 13 and 14, the deflection plate 24 is fixedly mounted on the lower end face of the movable frame 2 through an auxiliary plate 23. The auxiliary plate 23 contacts the deflection plate 24 at both ends thereof and the remaining portion of the auxiliary plate is recessed to form a space similar to the space 10 in the preceding embodiment.

On the upper face of the deflection plate 24 facing the space 10 are provided a plurality of blind holes 25 into which rams 12 are inserted such that during the downward movement of the rams 12 the upper portion thereof is in contact with the lower face of the space 10. Each blind hole is provided with a stopper 11' to prevent the ram 12 from escaping therefrom. The male die is detachably mounted on the lower face of the deflection plate 24. The total cross sectional area of the rams 12 in the deflection cylinders 11 is made substantially equal to the total cross sectional area of the pistons 7 of the pressure cylinders 4 and each of the deflection cylinders is in communication with the fluid pressure system of the main hydraulic cylinders.

By putting the material between the male die 8 on the lower face of the deflection plate 24 and the female die 9 on the fixed frame 3 and supplying an actuating fluid into the main hydraulic cylinders 4, the movable frame 2 is lowered and the material is formed by the dies. Since, at the same time, the deflection cylinders 11 are also supplied with the actuating fluid, the space 10 is enlarged by the rams of the cylinders 11 to thereby compensate for the deflection of the movable frame and the fixed frame as in the preceding embodiment and the material is formed as an L-shaped beam without convex or concave warp of the center portion thereof.

The deflection unit according to the present invention can be directly attached to the conventional press-forming apparatus and easily and completely eliminate convex and concave warp of the center portion of the formed L-shaped beam.

It should be understood that, although in the foregoing only embodiments for forming L-shaped beams from metal plate material or synthetic resin plate material are described, other shaped beam such as, for example, polygonal beams or semicircular beams, free from convex and concave warp can be formed by using corresponding dies. Further, by successively repeating the L-pressing operation two or three times along different bending lines, an angled U-shaped channel member or a rectangular tube may be formed.

As described hereinbefore, the present invention intends to provide a uniform load distribution which is effective to compensate for the deflection of the movable frame and the fixed frame which, in turn, cause the convex or concave warp of the press-formed material, by providing a plurality of deflection cylinders independently from the main hydraulic cylinders. And, when stop valves are provided in the pipes of the respective deflection cylinders, it becomes possible to compensate for the deformation of the frames by preliminary deflecting the movable frame by an amount which corresponds to the deformation or to compensate for the deformation in the press-forming period. Therefore, according to the present invention plates of any material can be press-formed with high preciseness.

What is claimed is:

1. A press-forming apparatus comprising a pair of C-shaped side frames disposed at a constant spacing parallel to each other, the side frames having a lower and an upper portion, a fixed frame fixed to the lower portion of said pair of side frames and having an upper surface, a female die mounted on the upper surface of the fixed frame, a pair of main hydraulic cylinders fixedly mounted on the upper portion of said pair of side frames, the main hydraulic cylinders having a piston, a movable frame supported above the fixed frame by the pistons of the pair of main hydraulic cylinders and having a lower surface, a male die mounted on the lower surface of the movable frame, a space in the movable frame adjacent and along the lower surface thereof, a plurality of deflection cylinders mounted in the space and arranged in a row, each deflection cylinder having a ram, the total cross sectional area of the rams of the deflection cylinders being substantially the same as that of the pistons of the pair of main hydraulic cylinders, and means for connecting the fluid paths of the main hydraulic cylinders with the fluid paths of the deflection cylinders whereby the fluid paths are in communication.

2. The press-forming apparatus of claim 1, further comprising a stop valve in the fluid path of each of the deflection cylinders for opening and closing the fluid path and for selectively connecting the fluid path with the fluid paths of the main hydraulic cylinders.

3. The press-forming apparatus of claim 1, further comprising a deflection plate forming the space, the deflection plate having a plurality of blind holes into which the rams are inserted to form a deflection unit.

* * * * *